United States Patent [19]

Moseley

[11] Patent Number: 4,790,459

[45] Date of Patent: Dec. 13, 1988

[54] CHILD CARRY DEVICE

[76] Inventor: Mark R. Moseley, 1760 Wellesley Ave., West Los Angeles, Calif. 90025

[21] Appl. No.: 70,294

[22] Filed: Jul. 6, 1987

[51] Int. Cl.[4] ..... A61G 1/00

[52] U.S. Cl. ..... 224/159

[58] Field of Search ..... 224/253, 157–161, 224/270, 252; 108/43; D3/31; 297/1

[56] References Cited

U.S. PATENT DOCUMENTS 3,541,976 11/1970 Rozas ..... 108/43

FOREIGN PATENT DOCUMENTS 471727 1/1929 Fed. Rep. of Germany ..... 224/270
960444 4/1950 France ..... 224/161
585378 2/1947 United Kingdom ..... 224/159
678225 8/1952 United Kingdom ..... 224/160

*Primary Examiner*—Henry J. Recla
*Assistant Examiner*—Robert Petrik

[57] ABSTRACT

A child carrying device for transporting a child in a natural fashion upon the hip of a person. This is a flexible horizontal seat which is worn in the manner of a holster and which folds down when not in immediate use. When in use, the child's weight is born through the seat into the hip via attachments to a hip pad, and onto the upper leg of the person through metal hinges which communicate with a thigh pad shaped to contour the upper leg. Hinges attach to the outermost aspect of the seat and to a central position on the thigh pad. A vertical strap connects the thigh pad to aforementioned hip pad.

6 Claims, 5 Drawing Sheets

CHILD CARRY DEVICE

BACKGROUND OF INVENTION

The need and subsequent conception of this device came about with the birth of my first child.

Carrying a child upon one's hip is the most natural and indeed the most likely choice when working about the house. The difficulty two fold. One in order to maintain the child on the hip. One must bend laterally in order to center the combined weight of oneself and the child while at the same moment increasing the horizontality of the hip. This is tiresome and unhealthy for the parent, however, the child is quite content being in close proximity to the parent. The second difficulity is that one or both hands must be employed constantly in order to insure the childs continued position.

My first solution to this problem was to fashion a triangular wedge of leather and wood which was maintained in position with a belt. This worked well, however, it shortly became apparent that eight includes of wood thrusting out into space would be a physical and visual difficulty. The present design incorporates a leather seat and a hinge system for convenient folding away when not in use.

There are two basic types of child carrier's on the market today, they are a back pack and a belly pack. They each are suspended from shoulder straps and each have some problems.

The back pack is best for the long walk but impossible to use comfortably in the home or while shopping. The child is behind the parent, out of sight, and can do great mischief when the parent is otherwise occupied. As well it is difficult to remove and replace the child. The bellypack is best for the infant, however, it is extremely difficult to don and it places the child directly in the way of one's hand. The position of the child also caused an increase in the hordotic curve of the lumbar spine, a condition which exacerbates low back problem such as slipped disc.

The Hipster is small and convenient to use, a snap of the wrist and the seat is in place. The child can be placed on or removed from the device quickly and easily, as often as necessary.

The physiologic advantages include no unhealthy bending in order to comfortably center the childs weight, the buttressing effect of the device projects the weight toward one's own center of gravity thereby decreasing energy needed to maintain the childs weight.

The child is always in sight and in close proximity to the body and therefore parent and child both feel secure.

SUMMARY OF THE INVENTION

The principal components are as follows:

The hip pad consists of a roughly rectangular piece of leather of a synthetic material with similar qualities. Said hip pad is backed by felt for padding and supplied with belt loops, for suspension. Located centrally and inferiorly is a buckle to accept and provide height adjustment for the next principal component, the thigh pad.

The high pad is composed of rectangular piece of leather or other material, backed by felt for padding. Sandwiched between these is a similarily shaped although somewhat smaller section of aluminum. This allows shaping for comfort and dispersion of force for the same reason. Riveted to the central area of the said thigh pad is a vertical strap. This verticle strap wraps around and shares a rivet with the next component the hinge pivot assembly.

There are two hinge pivot assembly's, one at each end of the upright hinges. The pivot assembly is composed of an aluminum tube within a wrap of leather or other material. This wrap surrounds and extends one inch on either side of the tube. One pivot assembly is riveted centrally on the thigh pad. The other assembly is riveted to the outer most aspect of the seat inferiorly. The seat is composed of a material such as leather, strong enough to be safe, and flexible enough to be comfortable. One end of the seat connects and is riveted centrally to the high pad. The other end of the seat connects to the upper end of the hinges by way of one of the aforementioned hinge pivot assemblys.

The hinges themselves are composed of aluminum or synthetic material strong enough to support the weight of a child. They are doubly hinged centrally in order to fold open themselves when the device is not in use.

The novel features which are believed to be characteristic of the invention, both as to its organization and method of operation, together with further objectives and advantages thereof, will be better understood from the following description considered in connection with accompanying drawings in which a presently preferred embodiment of the invention is illustrated by way of example. It is to be expressly understood, however, that the drawings are for the purpose of illustration and description only and not intended as a definition of the limits of the invention.

BRIEF DESCRIPTION OF THE DRAWING

The drawings are five in number.

The first two

FIG. 2, FIG. 3 and FIG. 4 all have the parts numbered in reference with, and in order of mention in the Detailed Description of Invention. All parts can not be seen in all drawings. Therefore, all numbers may not be represented on all drawings. For this reason in the Detailed Description of Invention, a figure number and a part number will be given. FIG. 1, Part 1 for example, is the main structure of the invention. FIG. 2 is simply a perspective view of the invention when closed.

DETAILED DESCRIPTION OF THE DRAWING

Figure 1:
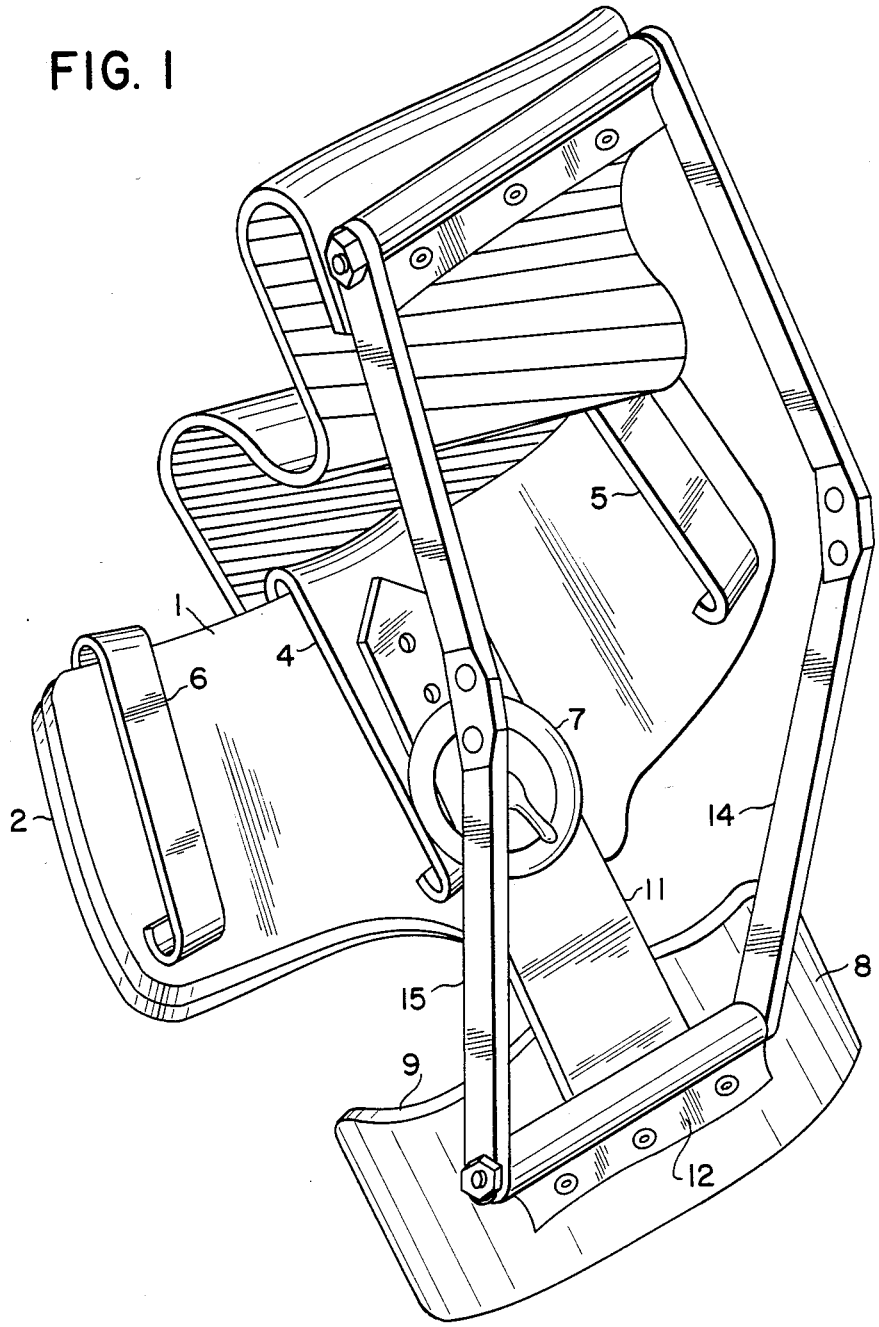
FIG. 1 and FIG. 2 show the device in perspective.
Figure 2:
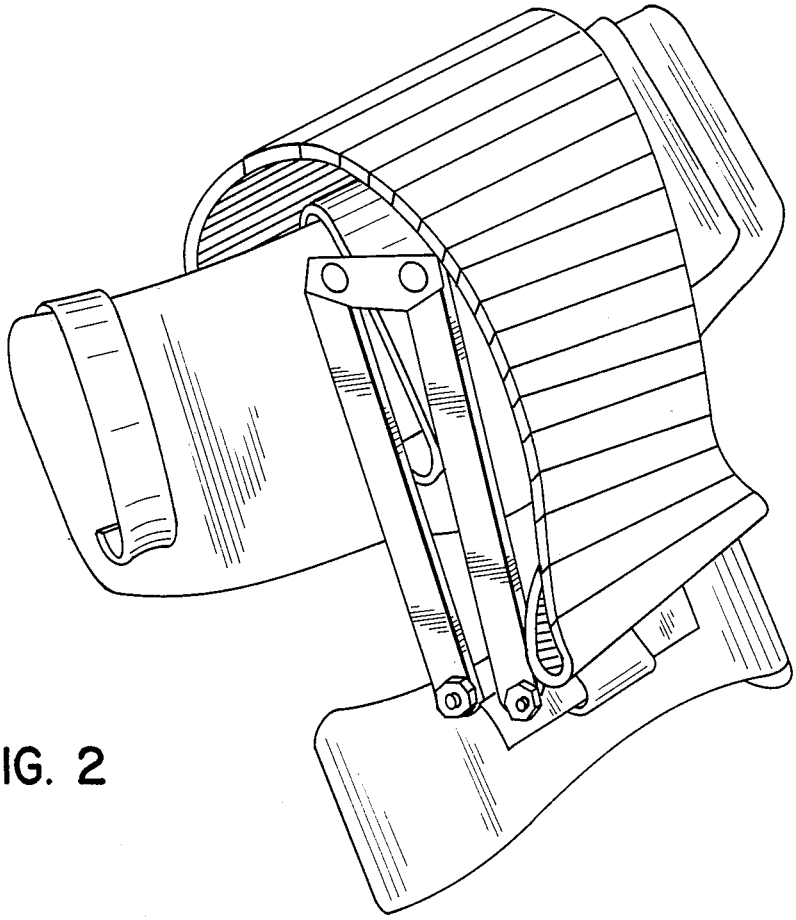
Figure 3:
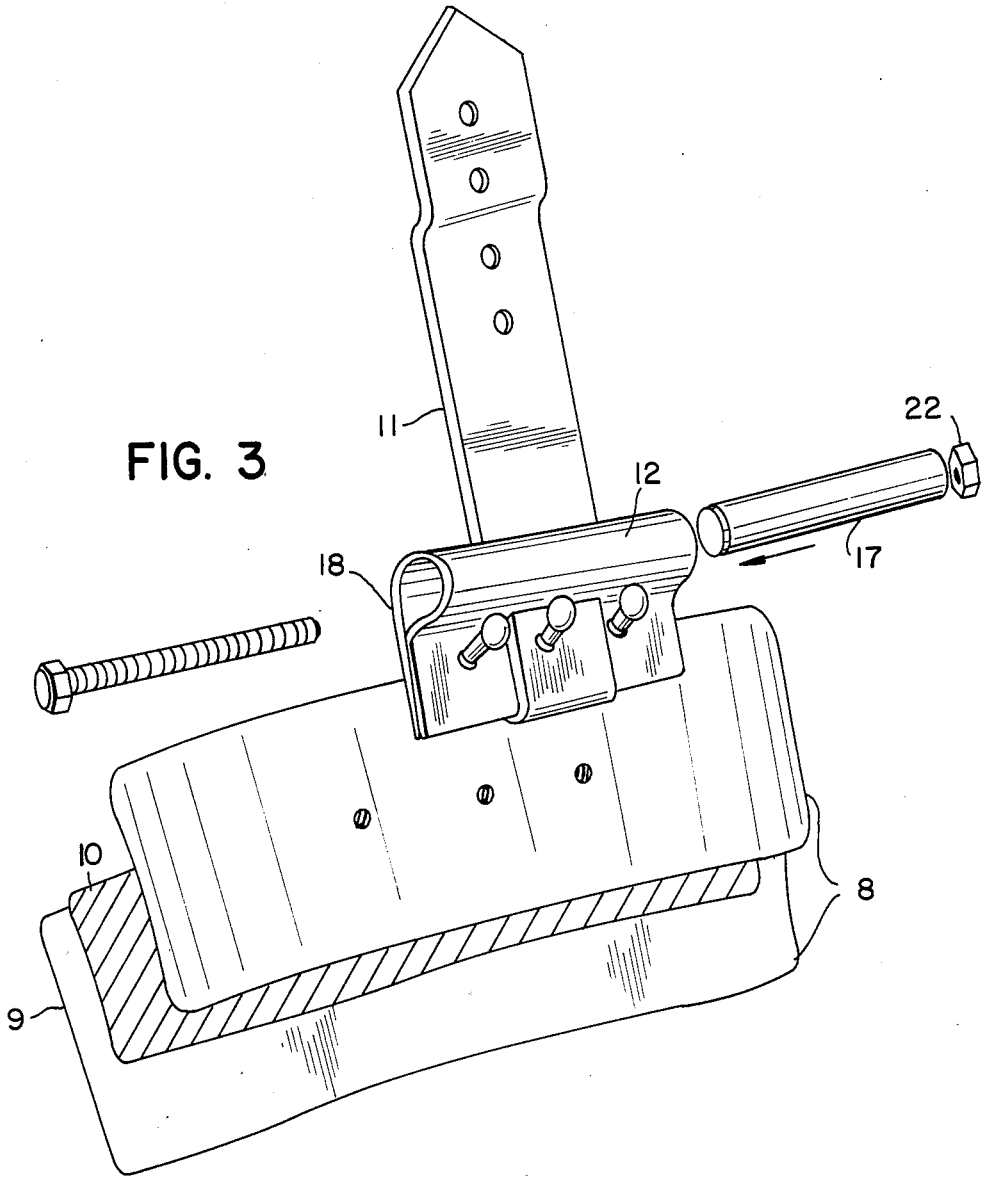
FIG. 3 and FIG. 4 are exploded views showing the device, the component parts, and how they correspond.

The hip pad FIG. 1, Part 1 consists of a rectulangular piece of leather or a synthetic material with similar qualities. Said hip pad is backed by felt, FIG. 1, Part 2 for padding and supplied with belt loops, FIG. 1, Parts 4, 5, and 6 for suspension. Located centrally and inferiorly is a buckle, FIG. 1, Part 7. Said buckle accepts and provides height adjustment for the next principal component the thigh pad, FIG. 1, Part 8. The thigh pad, FIG. 1, Part 8 is comprised of leather or other material backed by dacron felt, FIG. 1, Part 9 for padding. Sandwiched between these, is a similarly shaped although smaller section of aluminum, FIG. 3, Part 10. Said piece of aluminum allows shaping for comfort and dispersal of forces. Riveted to the central area of said thigh pad, FIG. 1, Part 8 is a vertical strap, FIG. 1, Part 11. This vertical strap wraps around and shares a rivet with the next component, the hinge pivot assemble, FIG. 3, Part 12, FIG. 4, Part 13. There are two identical hinge pivot assembles, FIG. 3, Part 12, FIG. 4, Part 13, one at each end of the pair of upright hinges, FIG. 1, Part 14, and Part 15. Said pivot assemble is composed of an aluminum tube, FIG. 4, Part 16, FIG. 3, Part 17 within a wrap of leather, FIG. 3, Part 18 and FIG. 4, Part 19 or other material. Said wrap of leather surrounds and extends an inch on either side of said aluminum tube. One said pivot assemble is riveted centrally on the thigh pad, FIG. 3, Part 8.

Figure 4:
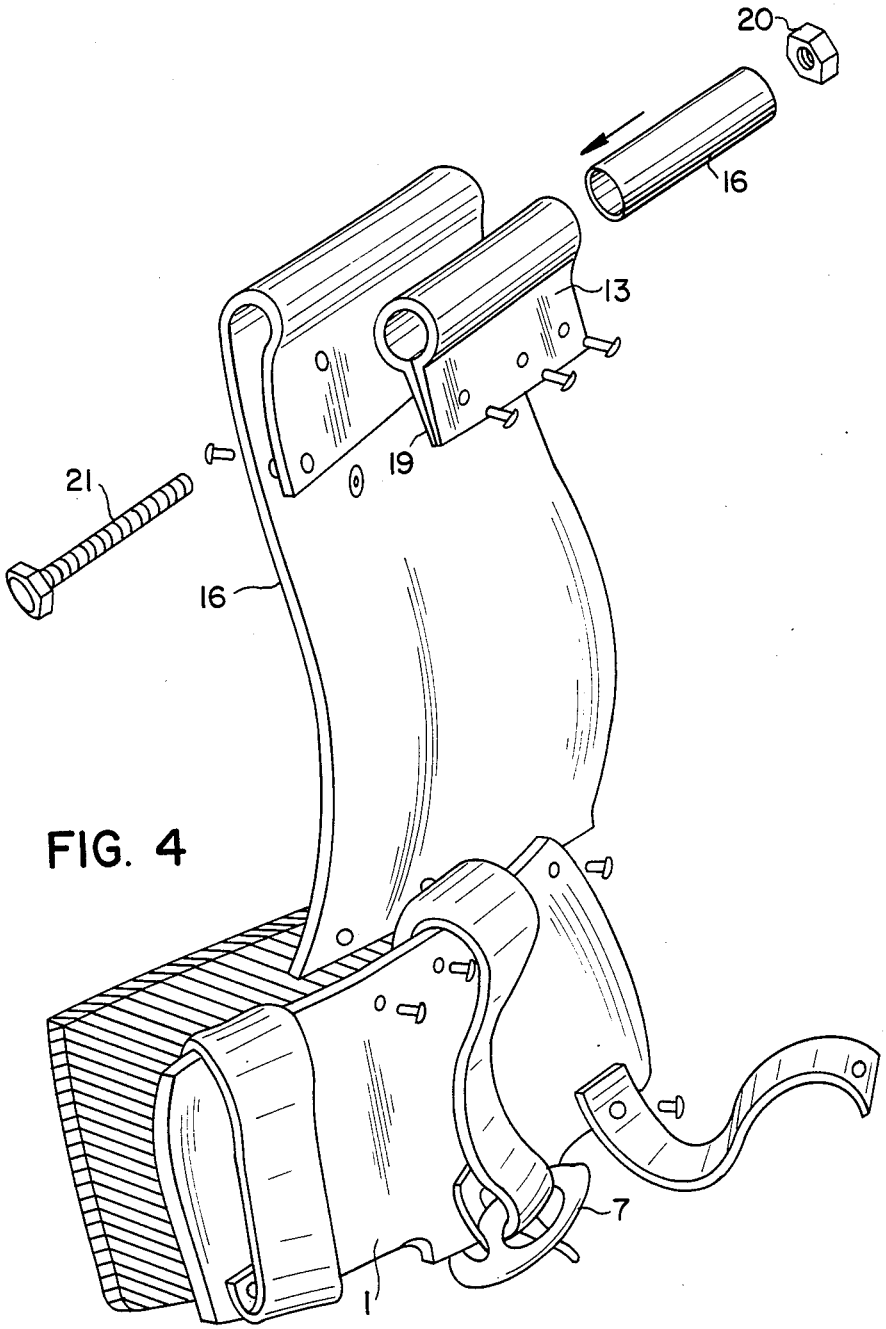
Figure 5:
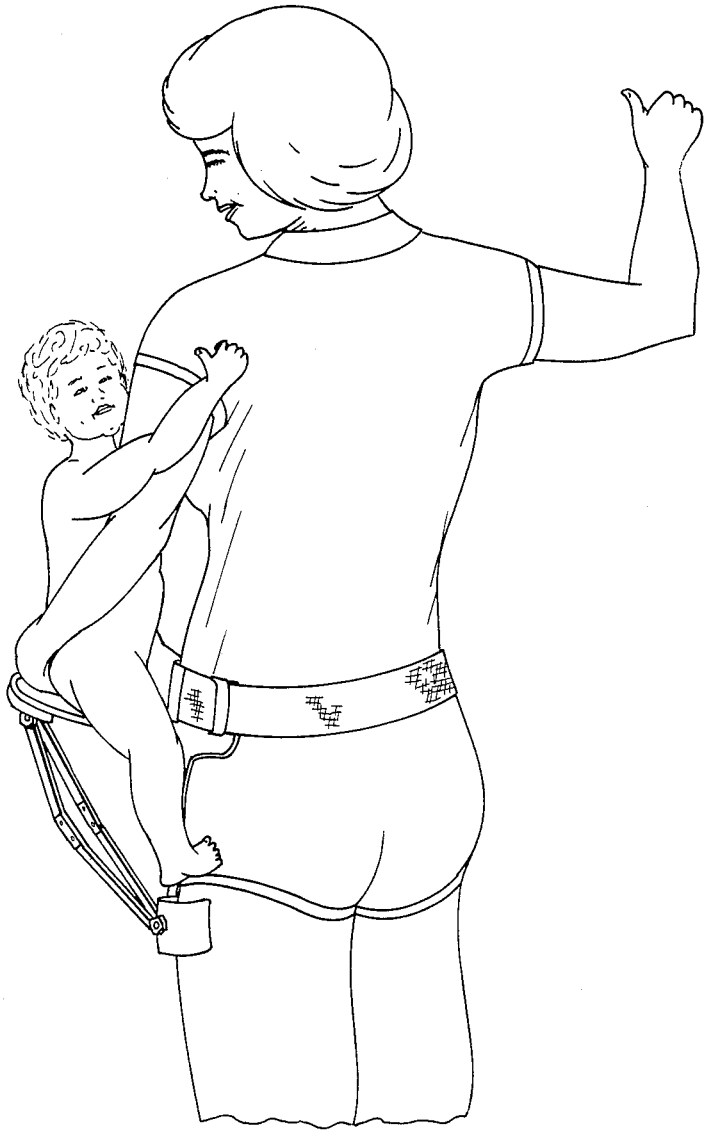
FIG. 5 is a rough sketch of the invention being used.

The other pivot assemble, FIG. 4, Part 13 is riveted to the outer most aspect of the seat, FIG. 4, Part 16 in an inferior position.

The Seat, FIG. 4, Part 16 is composed of material such as leather, strong enough to safely bear a childs weight, and flexible enough to be comfortable.

One end of the seat, FIG. 4, Part 16 connects and is riveted centrally to the thigh pad, FIG. 4, Part 1. The other end of the rectangular seat connects to the upper most end of the hinges, FIG. 1, Part 14 and Part 15, by way of aforementioned hinge pivot assemble, FIG. 4, Part 13 and secured by a nut, FIG. 4, Part 20 and bolt FIG. 4, Part 21. Inferiorly, the hinges attach to the hinge pivot assemble, FIG. 3, Part 12 and is secured by a nut, FIG. 3, Part 22 and a bolt, FIG. 3, Part 23.

The hinges, FIG. 1, Part 14 and Part 15 themsleves, are composed of aluminum, or other synthetic material strong enough to support the weight of a child.

These hinges, FIG. 1, Part 14 and Part 15 are double hinged centrally, in order to fold evenly upon themselves when the device is not in use.

I claim:

1. A child carrying device comprising:

a hip pad of rectangular configuration large enough to comfortably support a portion of the weight of a 6 to 18 month old child;

an arcuate thigh pad of rectangular configuration to comfortably support the remainder of the aforementiond child's weight;

a vertical strap which is dependent upon interconnecting said hipped and said thigh pad;

adjustable means including a buckle on the said hip pad coupling with said vertical strap;

a flexible seat having opposite ends and pliable enough to safely and comfortably support the posterior of a young child wherein one end couples with said hip pad;

a set of hinged non-ferrous upright buttresses connected between said thigh pad and said other end of said seat for conducting vertical load forces from said seat onto said thigh pad and toward the person's center of gravity.

2. In a child carrying device having a folded storage position and an unfolded operative position, the combination comprising:

a hip pad of arcuate configuration adapted to bear against the hip of the user when the device is in said operative position;

a thigh pad having an arcuate configuration adapted to bear against the thigh of the user when the device is in said operative position;

a flexible seat having opposite ends;

an articulated linkage connected between a selected end of said seat and said thigh pad;

said seat having its non-selected end connected to said hip pad;

said seat adapted to extend outwardly from said hip pad in response to extension of said articulated linkage when said device is in said operative position whereby said hip pad and said linkage constitute load carrying members for transmitting applied loads to the hip and thigh of the user; and a waist belt carried on said hip pad for encircling the user about the waist.

3. The invention as defined in claim 2 including:

an adjustable coupling strap disposed between and interconnecting said hip pad with said thigh pad.

4. The invention as defined in claim 3 wherein:

said flexible seat is a rectangular length of pliable material having its opposite ends secured to said hip pad and said linkage respectively.

5. The invention as defined in claim 4 wherein:

said linkage is pivotally attached at its ends to said hip pad and said thigh pad; and said linkage includes a pair of braces joined in a pivot connection at their adjacent ends.

6. The invention as defined in claim 5 wherein:

said linkage is foldable over upon itself and said seat is folded about said hip pad and said linkage when the device is in said storage position.

* * * * *